US007875759B2

(12) United States Patent
Shamsudin

(10) Patent No.: US 7,875,759 B2
(45) Date of Patent: Jan. 25, 2011

(54) PROCESS FOR EXTRACTING NATURAL GAS LIQUIDS FROM NATURAL GAS

(76) Inventor: Rafael Bin Mohd Shamsudin, No. 67, Jalan Damai, Kuala Lumpur (MY) 55000

( * ) Notice: Subject to any disclaimer, the term of this patent is extended or adjusted under 35 U.S.C. 154(b) by 939 days.

(21) Appl. No.: 11/718,317

(22) PCT Filed: Nov. 3, 2005

(86) PCT No.: PCT/NZ2005/000293

§ 371 (c)(1),
(2), (4) Date: Apr. 30, 2007

(87) PCT Pub. No.: WO2006/049515

PCT Pub. Date: May 11, 2006

(65) Prior Publication Data

US 2008/0116115 A1 May 22, 2008

(30) Foreign Application Priority Data

Nov. 4, 2004 (MY) ..... PI 2004 4581

(51) Int. Cl.
*C07C 7/08* (2006.01)

(52) U.S. Cl. ..... 585/833; 585/864; 585/867; 62/632; 62/636; 62/625

(58) Field of Classification Search ..... None
See application file for complete search history.

(56) References Cited

U.S. PATENT DOCUMENTS 3,090,683 A * 5/1963 Berger ..... 48/127.3
4,696,688 A * 9/1987 Mehra ..... 62/625
5,687,584 A * 11/1997 Mehra ..... 62/632
6,610,124 B1 * 8/2003 Dolan et al. ..... 95/98

* cited by examiner

*Primary Examiner*—Tam M Nguyen
(74) *Attorney, Agent, or Firm*—Edwin D. Schindler

(57) ABSTRACT

A process for extracting natural gas liquids (NGLs) from natural gas that involves contacting natural gas from one source with crude, or heavy, oil from a different source under conditions that promote enrichment of the crude or heavy oil with NGLs from the natural gas. Apart from functioning as an absorbent fluid, the crude or heavy oil also functions as the carrier medium for the absorbed. NGLs. When practicing the process, unlike conventional methods, there is no need to regenerate the absorbent fluid, in this case the crude and heavy oil, for recycling.

20 Claims, 9 Drawing Sheets

(CRUDE OR HEAVY OIL CONTACTING MAIN NATURAL GAS STREAM)

(JOULE-THOMSON PROCESS - SUPPLEMENTED WITH REFRIGERATION)

(LEAN OIL ABSORPTION PROCESS)

(CRUDE OR HEAVY OIL CONTACTING MAIN NATURAL GAS STREAM)

(CRUDE OR HEAVY OIL CONTACTING WITH CONDENSATES IN STABILISER)

(CRUDE OR HEAVY OIL CONTACTING WITH STABILISER OVERHEAD VAPOUR STREAM)

(CRUDE OR HEAVY OIL CONTACTING LPG RICH FLASH GAS)

(STABILISED LIQUID CONTACTING MAIN NATURAL GAS STREAM WITH CRUDE OR HEAVY OIL CONTACTING CONDENSATE AT STABILISER)

PROCESS FOR EXTRACTING NATURAL GAS LIQUIDS FROM NATURAL GAS

BACKGROUND OF THE INVENTION

1. Field of the Invention

The present invention relates to a process for extracting Natural Gas Liquids (NGLs) from natural gas. The present invention is more particularly directed to a novel process for extracting NGLs from natural gas that is adaptable to new or for retrofit to existing oil and gas processing facilities.

2. Description of the Background Art

Raw natural gas comes from three types of wells: oil wells, gas wells, and condensate wells. Natural gas that comes from oil wells is typically termed 'associated gas'. This gas can exist separate from oil in the formation (free gas), or dissolved in the crude oil (dissolved gas). Natural gas from gas and condensate wells, in which there is little or no crude oil, is termed 'non-associated gas'. Gas wells typically produce raw natural gas by itself, while condensate wells produce free natural gas along with a semi-liquid hydrocarbon condensate. Whatever the source of the natural gas, once separated from crude oil (if present) it commonly exists in mixtures with other hydrocarbons; principally ethane, propane, butane, and pentanes and to a lesser extent heavier hydrocarbons. Natural gas as used in this description refers mainly to non-associated gas or a mix of associated and non-associated gas.

Natural Gas Liquids (NGLs) include ethane, propane, butane, iso-butane, and natural gasoline. Natural gasoline is a mixture of hydrocarbons, mostly pentanes and heavier hydrocarbons. Liquefied Petroleum gas (LPG) refers to predominantly propane and butane, either separately or in mixture. The term NGL as used in this specification refers mainly to small quantities of propane, butanes and natural gasoline.

Recent substantial increases in the demand for NGL has spurred demand for new processes of obtaining NGL from natural gas that yield higher recovery levels.

The conventional processes for extracting NGL from natural gas include those based upon cooling and refrigeration, recycled lean oil absorption, cryogenic process, etc. Typical Turbo-Expander (TBX), straight refrigeration, Joule-Thomson valve (JT), and lean oil processes for extracting NGLs are respectively schematically illustrated in FIGS. 1 to 4. Depending upon the pressure and content of the natural gas source, each of these prior art processes or a combination thereof may be employed. In a number of contemporary refining processes, NGLs are broken down into their base components to be useful by liquefaction and cryogenic distillation. Refrigeration for separation is supplied totally or partially by expansion of the natural gas in a Turbo-Expander. In the lean oil absorption process, NGLs are separated by liquefaction and treatment with an absorption medium. In this process, a natural gas stream is contacted with absorption oil and the NGL components are absorbed and thereafter desorbed and recovered. This process requires expensive regeneration facilities to re-circulate the lean oil.

Due to the increasing worldwide demand for NGL, leading to large volumes of natural gas needing to be processed, there is an urgent need in the art to find efficient methods to recover more of the NGLs in a natural gas feed-stream.

SUMMARY OF THE INVENTION

An objective of at least one embodiment of this invention is to enhance the recovery of NGLs by contacting natural gas or un-stabilised condensate with an absorbent which is crude or heavy oil sourced from another processing train. The resulting liquid stream may be either exported under pressure or stabilized for storage in atmospheric tanks. This avoids the need to regenerate the absorbent fluid for recycle, and is therefore an open loop system. As such, the absorbent fluid also functions as a NGL carrier fluid which when stabilized allows for safe storage in atmospheric tanks.

The present invention teaches a process for the recovery of NGLs from natural gas. It is a major objective of at least one embodiment of the present invention to provide a process for extracting NGLs from natural gas into the product liquid stream. According to this process, natural gas from a processing train from which the NGLs are to be extracted is brought into contact in at least one contactor column with crude or heavy oil from a different processing train. The conditions under which the contact occurs are predetermined to promote absorption of the NGLs from the natural gas into the crude or heavy oil and displacement of light hydrocarbons from the crude or heavy oil into the natural gas. In this way, there is generated a NGLs-rich crude or heavy oil product liquid stream and NGLs-lean gas.

It is another major objective of at least one embodiment of the present invention to provide a process for extracting NGLs from natural gas whereby natural gas from a processing train from which the NGLs are to be extracted is firstly condensed in a dewpoint control system to form a NGLs-rich un-stabilised condensate. The hydrocarbons-rich un-stabilised condensate is then brought into contact in at least one condensate stabiliser column with crude or heavy oil from a different processing train under predetermined conditions that promote enrichment of the crude or heavy oil with NGLs from the NGLs-rich un-stabilised condensate and displacement of light hydrocarbons from the crude or heavy oil and the un-stabilised condensate into the generated vapour stream of the condensate stabiliser column.

It is yet another major objective of at least one embodiment of the present invention to provide a process for extracting NGLs from natural gas whereby natural gas from a processing train from which the NGLs are to be extracted is firstly condensed in a dewpoint control system to form a NGLs-rich un-stabilised condensate. The NGLs-rich un-stabilised condensate is then routed to a condensate stabiliser column. The NGLs-rich overhead vapour from the condensate stabiliser column is then routed to a contactor column where it is brought into contact with crude or heavy oil from a different processing train under predetermined conditions that promote enrichment of the crude or heavy oil with NGLs from the NGLs-rich overhead vapour and displacement of light hydrocarbons from the crude or heavy oil into the overhead vapour.

It is a related objective of at least one embodiment of the present invention that the NGLs-rich un-stabilised condensate described above is routed to a de-propaniser prior to delivery to the condensate stabiliser column.

It is still yet another major objective of at least one embodiment of the present invention to provide a process for extracting NGLs from natural gas whereby natural gas from a processing train from which the NGLs are to be extracted is firstly condensed in a dewpoint control system to form a NGLs-rich un-stabilised condensate. The NGLs-rich un-stabilised condensate is then routed to a condensate stabiliser column that is re-configured as a de-propaniser. The NGLs-rich un-stabilised condensate from the bottom of the condensate stabiliser column is then routed to a pressure letdown valve followed by a flash vessel. The NGLs-rich flash gas from the flash vessel is then routed to a contactor column where it is brought into contact with crude or heavy oil from a different processing train under predetermined conditions that promote absorption of the NGLs from the hydrocarbons-rich flash gas into the crude or heavy oil and displacement of light hydrocarbons from the crude or heavy oil into the flash gas.

It is still yet another major objective of at least one embodiment of the present invention to provide a process for extracting NGLs from natural gas whereby natural gas from a processing train from which the NGLs are to be extracted is brought into contact in at least one contactor column with stabilised liquid which is a mix of condensate from the natural gas processing train and crude or heavy oil from a different processing train. The natural gas from a processing train from which the NGLs are to be extracted is separated into a NGLs-rich un-stabilised liquid phase and a NGLs-lean gas phase. The NGLs-rich un-stabilised liquid is then brought into contact in at least one condensate stabiliser column with crude or heavy oil from a different processing train under predetermined conditions that promote absorption of the NGLs from the NGLs-rich un-stabilised liquid into the crude or heavy oil to generate a NGLs-rich crude or heavy oil and condensate mixture liquid and displacement of light hydrocarbons from the crude or heavy oil and the un-stabilised condensate into the generated vapour stream of the condensate stabiliser column. Part of the NGLs-rich crude or heavy oil and condensate mixture liquid is then recycled to the natural gas and stabilised liquid contactor(s) as mentioned above.

It is yet another objective of at least one embodiment of the present invention that the NGLs-rich crude or heavy oil generated via the present process is routed to a de-propaniser if required prior to delivery to the condensate stabiliser column.

It is yet another objective of at least one embodiment of the present invention that the NGLs-rich crude or heavy oil generated via the present process is exported under pressure in a separate pipeline.

It is yet another objective of at least one embodiment of the present invention that the NGLs-rich crude or heavy oil generated via the present process is stabilised in at least one stabilisation column for storage under atmospheric pressure for export.

There has thus been outlined, rather broadly, the more important features of the invention in order that the DETAILED DESCRIPTION thereof of the preferred embodiments that follows may be better understood, and in order that the present contribution to the art may be better appreciated. Before explaining preferred embodiments of the invention in detail, it is to be understood that the invention is not limited in its application to the details of construction and to the arrangements of the components set forth in the following description or illustrated in the drawings. The invention is capable of other embodiments and of being practiced and carried out in various ways.

BRIEF DESCRIPTION OF THE DRAWINGS

For a better understanding of the invention, its operating advantages and the specific objects attained by its uses, reference should be had to the accompanying drawings and descriptive matter in which there are illustrated preferred embodiments of the invention. The drawings are merely illustrative in nature and should not be construed as limiting the invention in any way.

Figure 1:
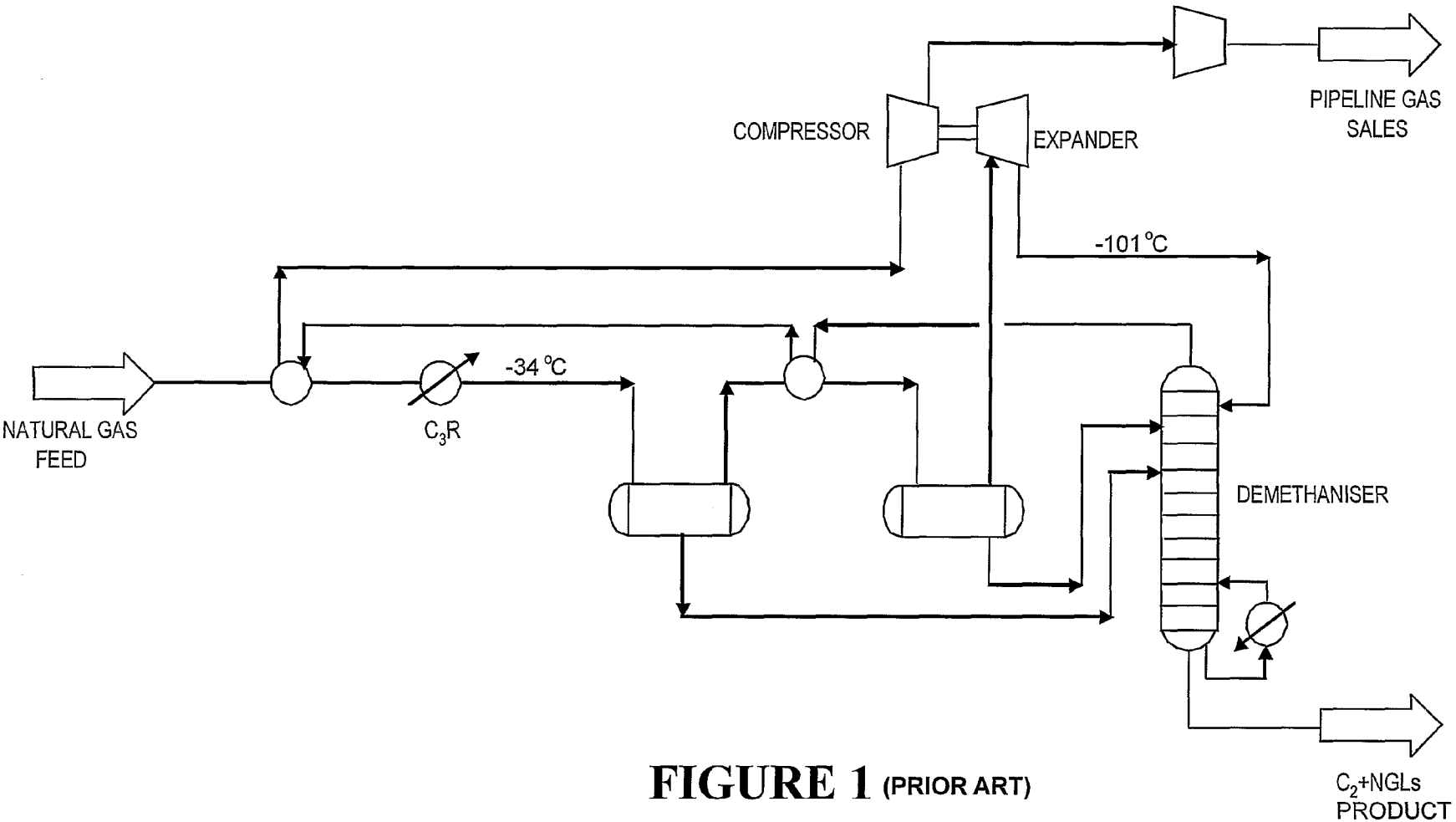
FIGURE 1 (PRIOR ART)
FIG. 1 illustrates schematically an example of a prior art 'Turbo-Expander' (TBX) process involved in the process of NGL extraction.
Figure 2:
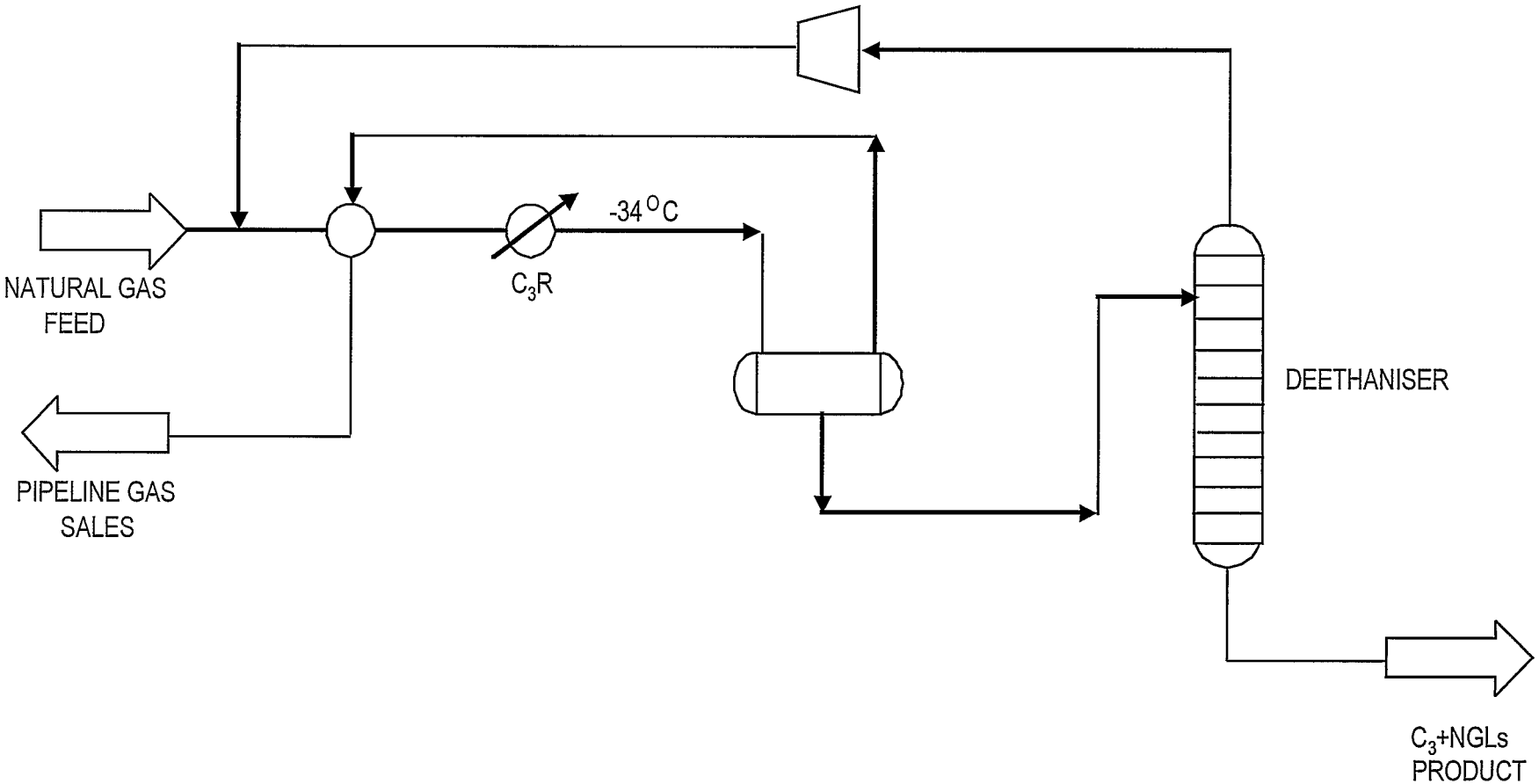
FIGURE 2 (PRIOR ART)
FIG. 2 illustrates schematically an example of a prior art 'straight refrigeration' process involved in the process of NGL extraction.
Figure 3:
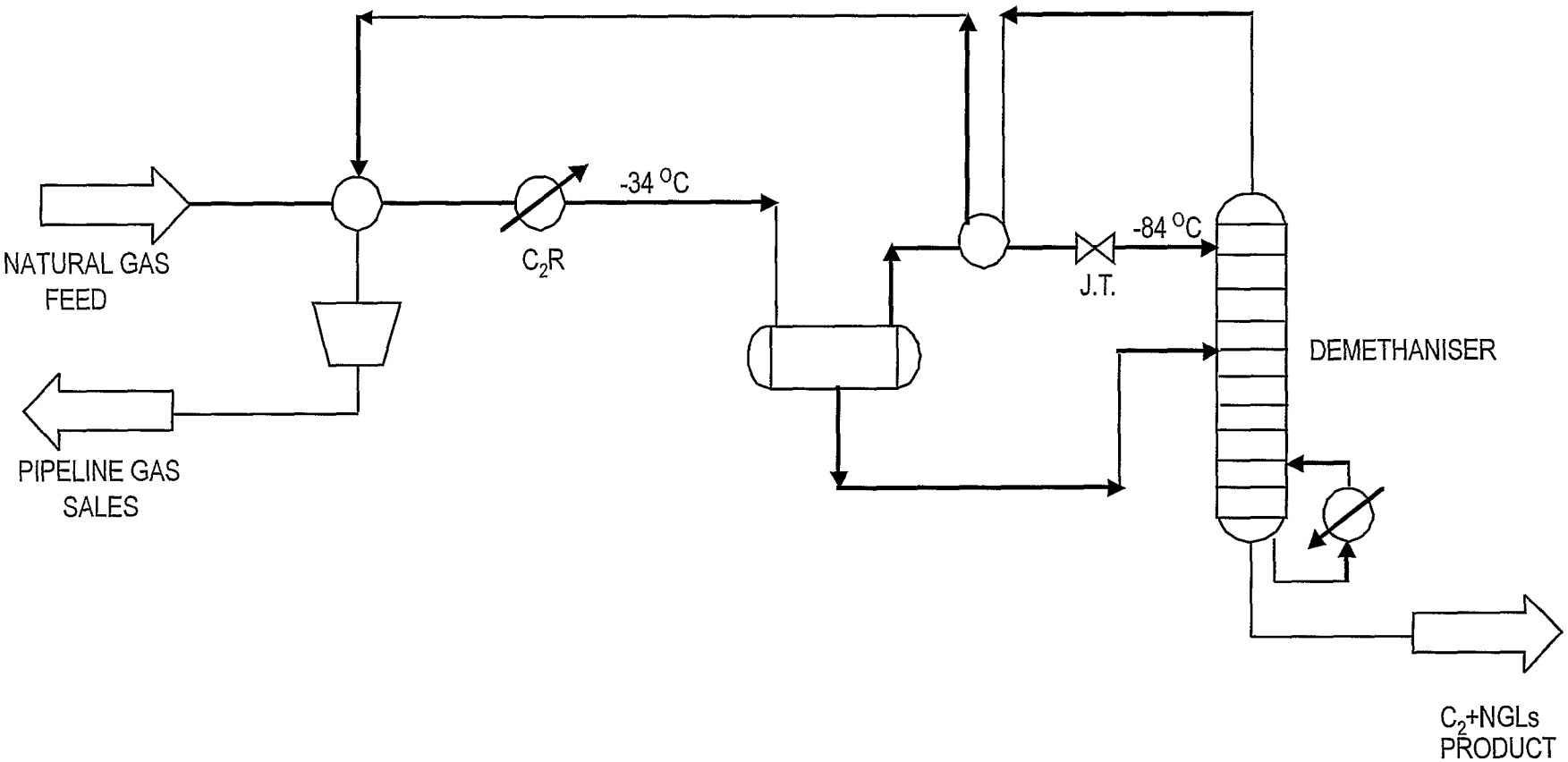
FIGURE 3 (PRIOR ART)
FIG. 3 illustrates schematically an example of a prior art 'Joule-Thomson (JT)' valve process involved in the process of NGL extraction.
Figure 4:
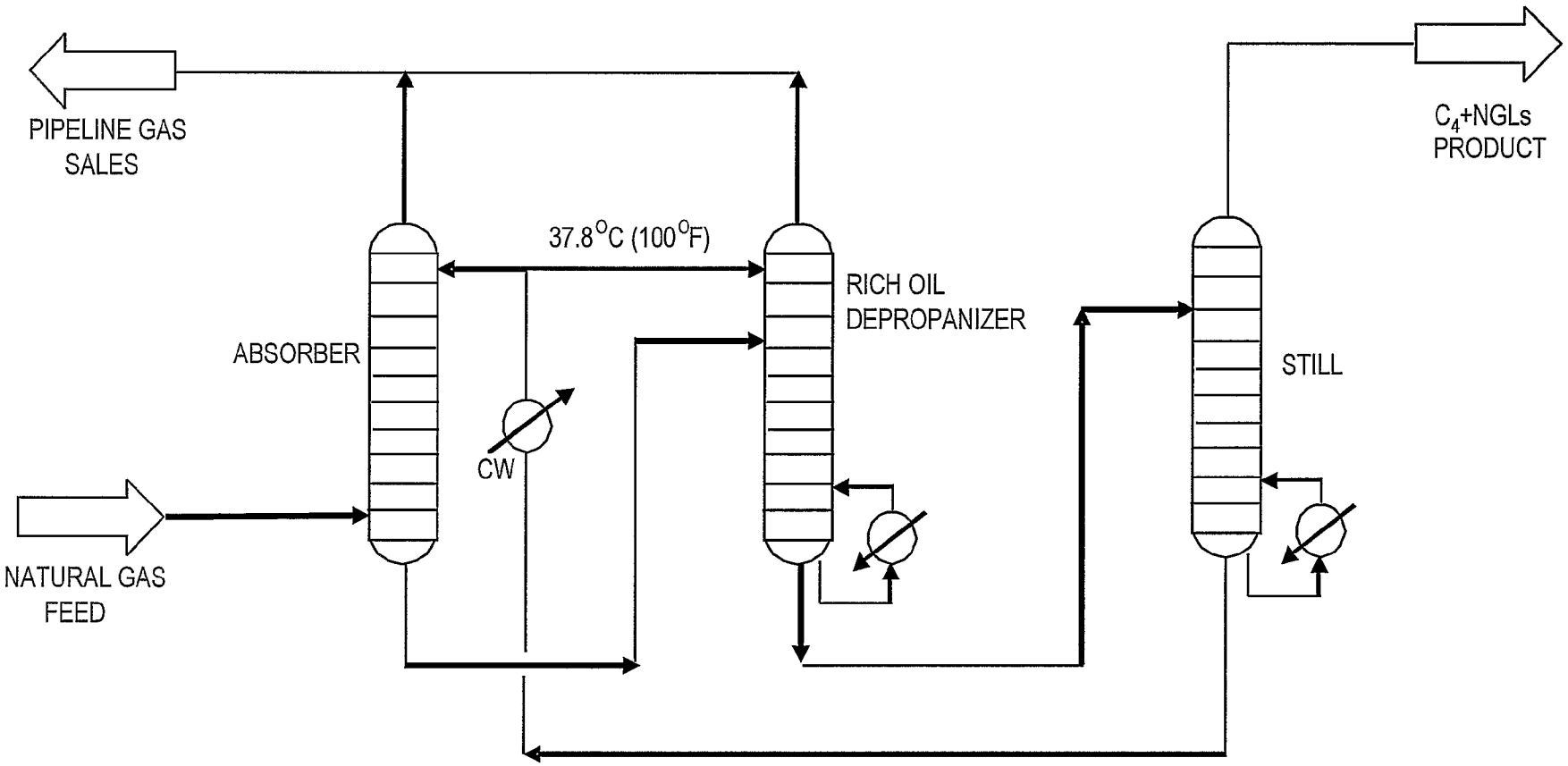
FIGURE 4 (PRIOR ART)
FIG. 4 illustrates schematically an example of a prior art 'lean oil' process involved in the process of NGL extraction.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. Combination of the various embodiments of the present invention as described herein may also be used depending on specific facility requirements.

DETAILED DESCRIPTION OF THE PREFERRED EMBODIMENTS

The present invention relates to a process that improves NGLs and condensate recovery from a natural gas processing facility by employing crude oil or any other heavy oils as an absorbent fluid. NGLs like propane, butanes and other heavier hydrocarbons in the natural gas stream are absorbed into the crude or heavy oil which may then be stabilised for storage and export as either a crude and condensate mix or as separate liquids (depending on the process configuration selected) that are laden with NGLs. The present invention differs from conventional lean and heavy oils absorption processes for condensate recovery in that it is an open loop system that eliminates the need for regeneration to re-circulate the crude oil or heavy oil. The process of the present invention may be used in any oil and gas production and processing facility.

Unlike a closed loop regenerative type process that requires further processing to liquefy the recovered NGLs suitably for pressurised storage and transportation, the present open loop process will enable the NGLs extracted from the natural gas stream to remain within the absorbent crude or heavy oil stream even when stabilised for storage in atmospheric tanks and subsequent export. It thus avoids the need for expensive LPG recovery, storage and transportation facilities, which in addition pose safety concerns. The crude or heavy oils that are laden with NGLs of the present process can then be stored and transported more safely to refineries for further processing and recovery of NGLs.

Figure 5:
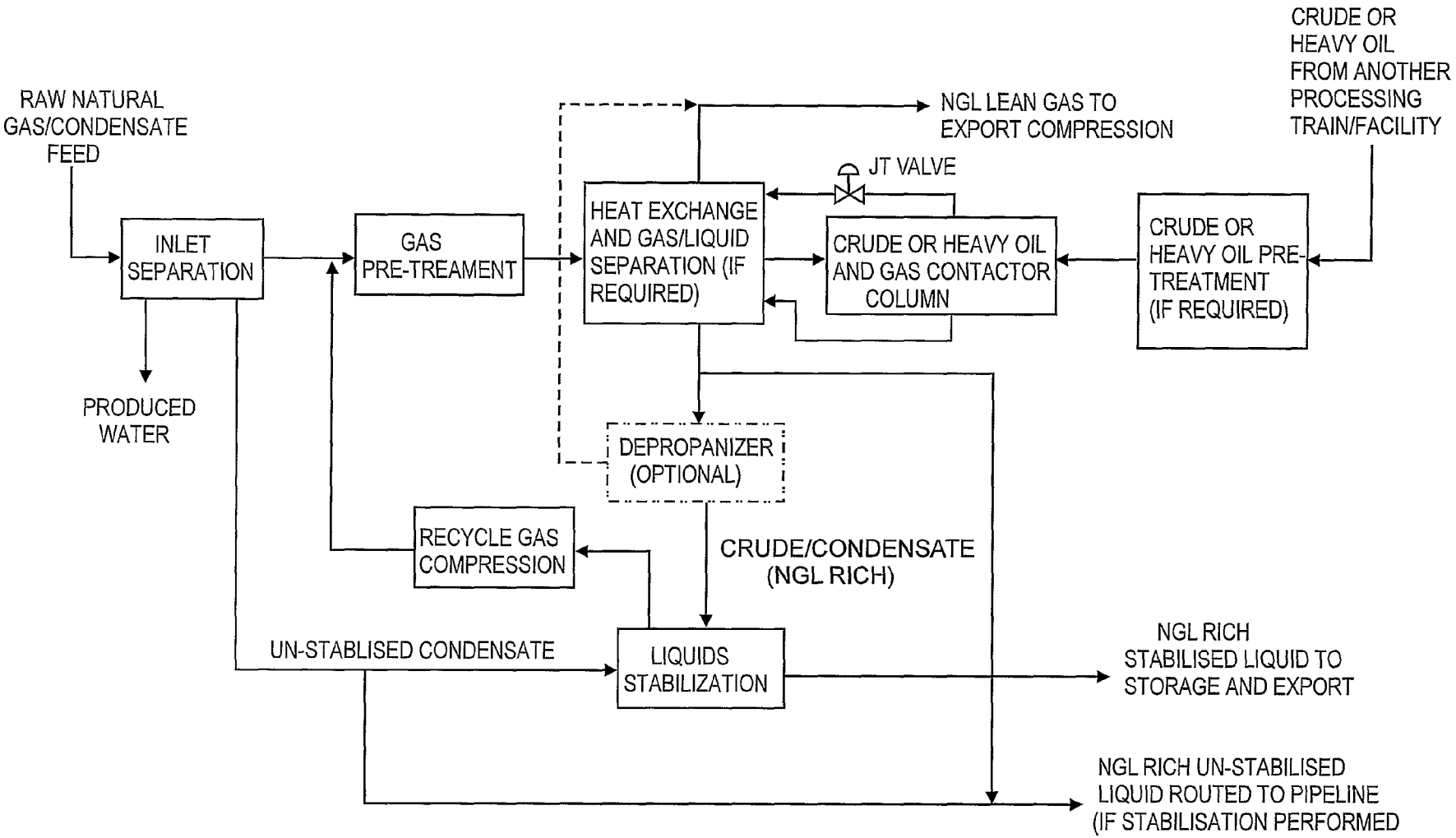
FIG. 5 illustrates schematically the process of the present invention according to a first preferred embodiment of the present invention.

The present invention, according to a first preferred embodiment, is illustrated schematically in FIG. 5 by way of a concise flow-diagram that is readily comprehensible by the skilled artisan. The present invention may be termed Open Loop Heavy Oil Absorption process (OLHOA process). This process can be used to contact crude or heavy oil from a processing train or facility with natural gas processed in a different production and/or processing train. Single or multiple absorption columns are used to contact the oil with the natural gas stream to absorb valuable NGLs from the natural gas stream. This process is also suitable for offshore installations particularly where crude oil and natural gas are produced simultaneously. As described above, the natural gas stream is contacted with crude from a different production stream and subsequently exported in a separate pipeline under pressure or stabilised in a stabilization column for storage under atmospheric conditions and export. This process scheme is particularly beneficial as it additionally avoids the need for deep chilling of the natural gas stream using Turbo-Expanders (TBX) or refrigeration units. This in turn avoids the need for excessive dehydration of the natural gas stream using, for example, molecular sieves.

Figure 6:
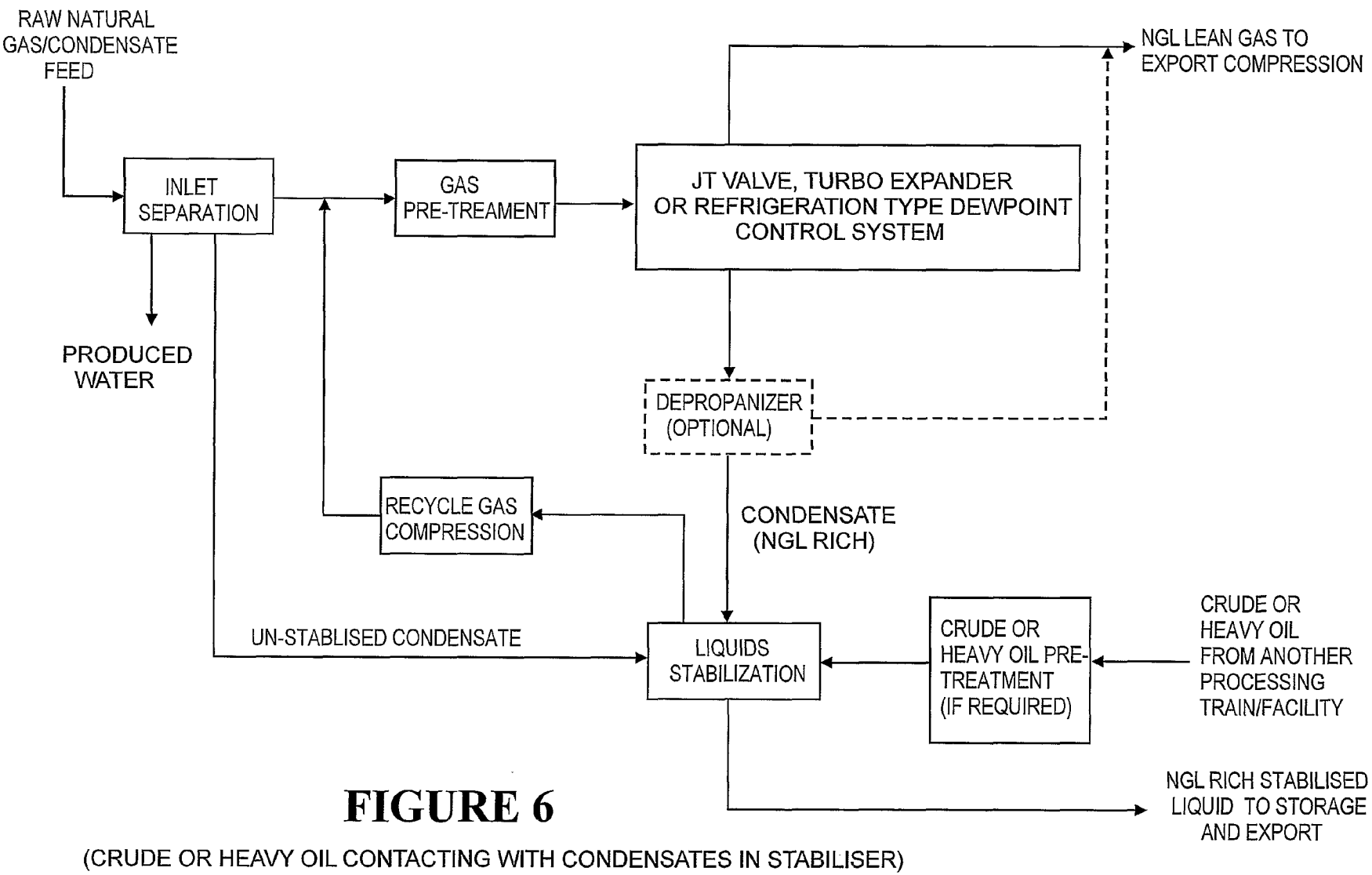
FIG. 6 illustrates schematically the process of the present invention according to a second preferred embodiment of the present invention.

The present invention, according to a second preferred embodiment, is illustrated schematically in FIG. 6. This process is particularly suitable for retrofit of existing natural gas processing facilities which are already fitted with Joule Thompson (JT) valve, turbo-expander or refrigeration unit to dewpoint the natural gas and for enhanced condensate recovery. In this process scheme, crude or heavy oil either from an adjacent processing train or a remote train is routed to the top tray of the condensate stabiliser column for contact with the un-stabilised condensate. The crude or heavy oil in this case functions as a column reflux and absorbs the NGLs whilst the lighter components and part of the propane are displaced from the crude and condensate and end up in the vapour stream in the column as column overheads. The stabiliser column bottoms will thus be a mix of crude and condensate which will be rich in NGLs that would otherwise have ended up in the overhead vapour recycle stream. This, apart from significantly increasing condensate recovery, will reduce the flow-rate of the column overhead vapour stream and thus reduce recycle compression power.

Figure 7:
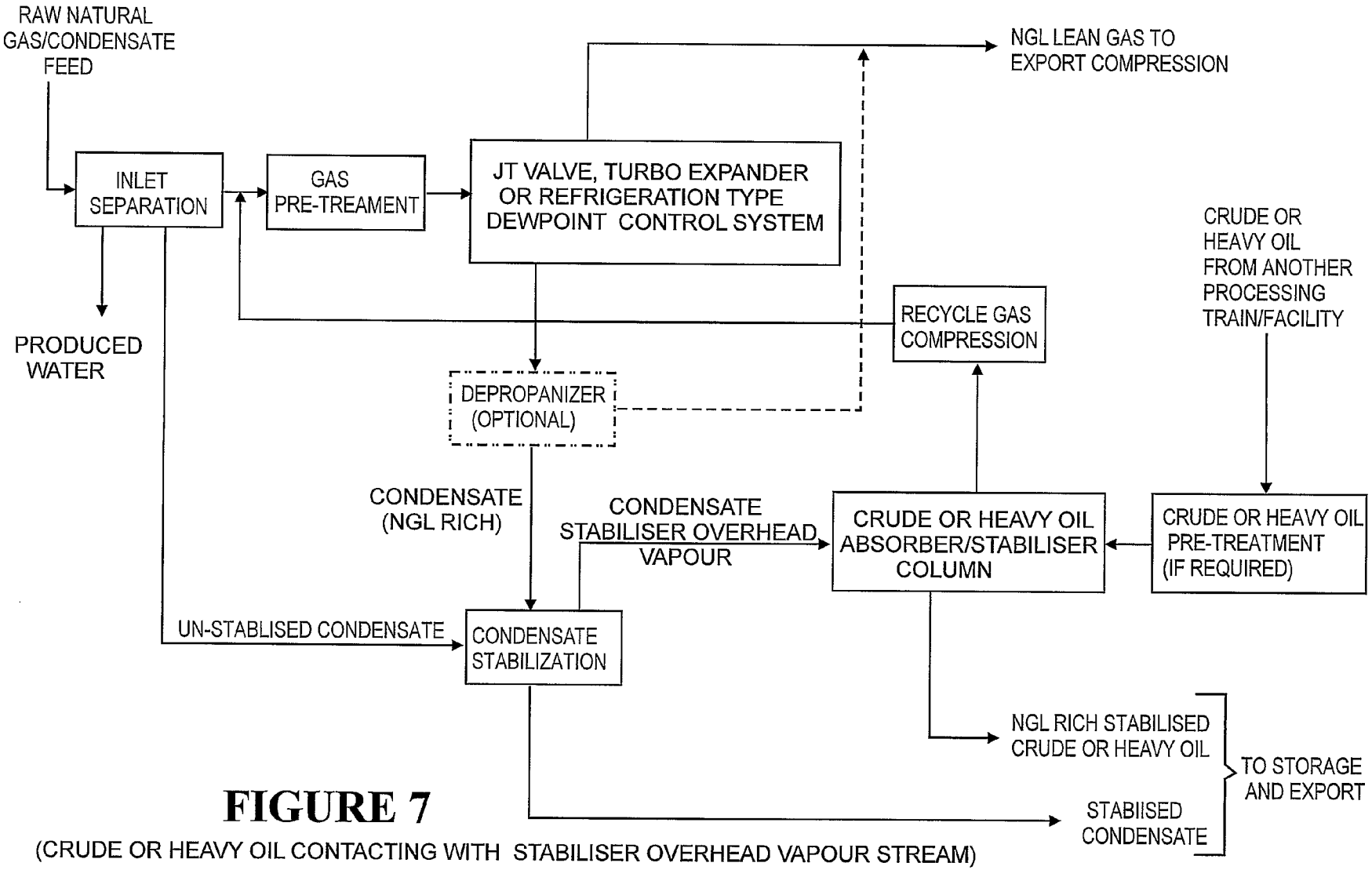
FIG. 7 illustrates schematically the process of the present invention according to a third preferred embodiment of the present invention.

The present invention, according to a third preferred embodiment, is illustrated schematically in FIG. 7, which constitutes an alternative process scheme to that shown in FIG. 6. In this scheme the overhead vapour stream from the condensate stabiliser is routed to another crude contacting and/or stabiliser column where the gas which is rich in NGLs is contacted with crude or heavy oil to produce stabilised or un-stabilised oil that is rich in NGLs. This scheme is advantageous if condensate and crude or heavy oils are to be produced and stored separately.

Figure 8:
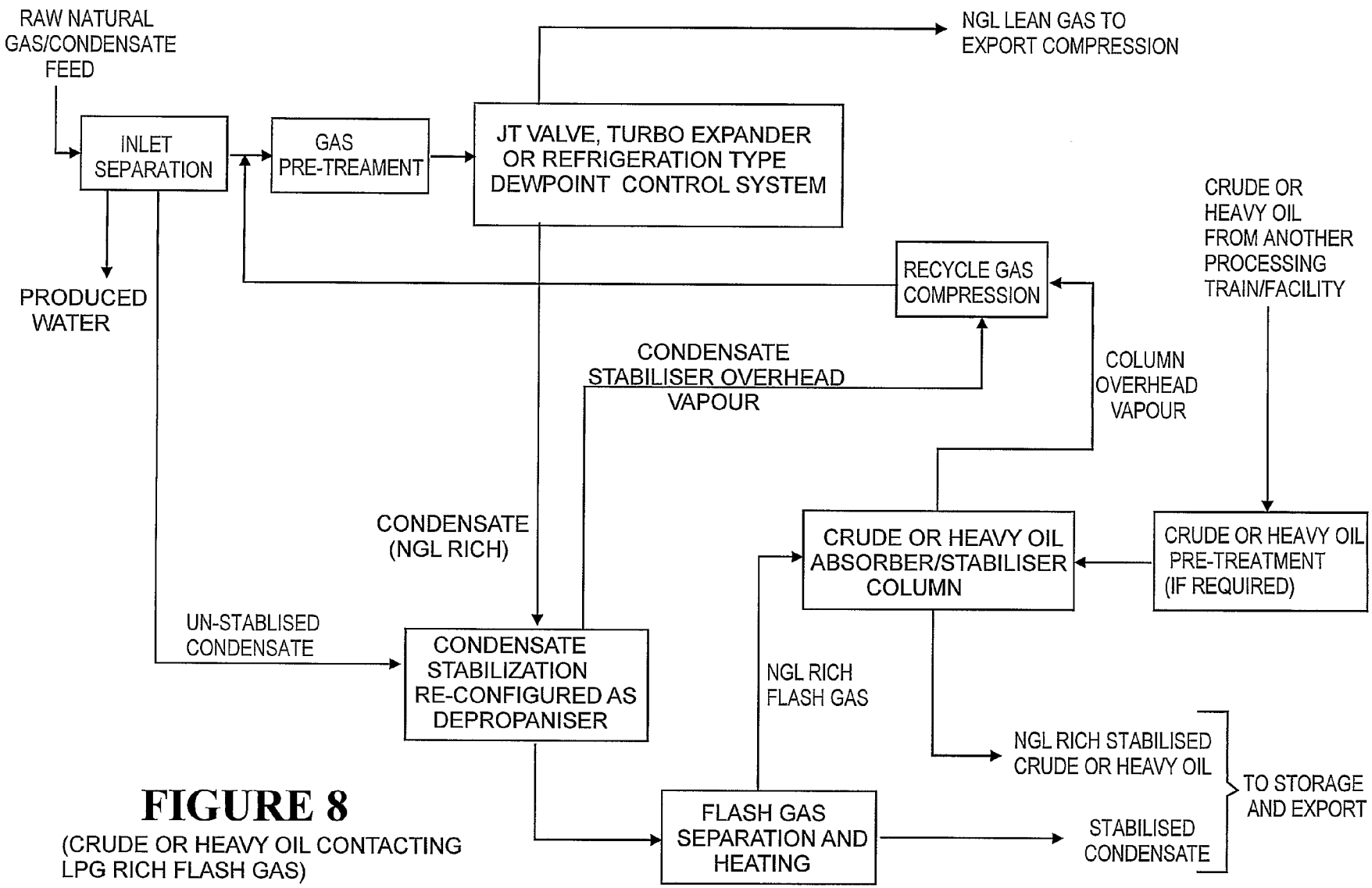
FIG. 8 illustrates schematically the process of the present invention according to a fourth preferred embodiment of the present invention.

The present invention, according to a fourth preferred embodiment, is illustrated schematically in FIG. 8. FIG. 8 shows a further variation of this process scheme by re-configuring the condensate stabiliser as a de-propaniser and routing the hot un-stabilised condensate from the bottoms of this column to a heater (if required) and a pressure letdown valve followed by a flash vessel. Flash gas from this flash vessel will be very rich in NGLs which will then be routed to a contacting column for counter current contact with crude or heavy oil. The required heat input by the upstream heater will be adequate to stabilise both the condensate from the flash vessel and the crude/heavy oil stream from the contacting column. The overhead vapour stream from the contactor, which will be leaner in NGLs content, will be recycled to the front end of the gas processing train. This configuration enables efficient contact of LPG rich gas with crude or heavy oil for reduced column size and heating duties. As with the process depicted in FIG. 7, this process scheme also produces separate stabilised condensate and crude or heavy oil streams and is particularly suitable for retrofits of existing gas processing facilities to enhance NGL and liquid recovery.

Figure 9:
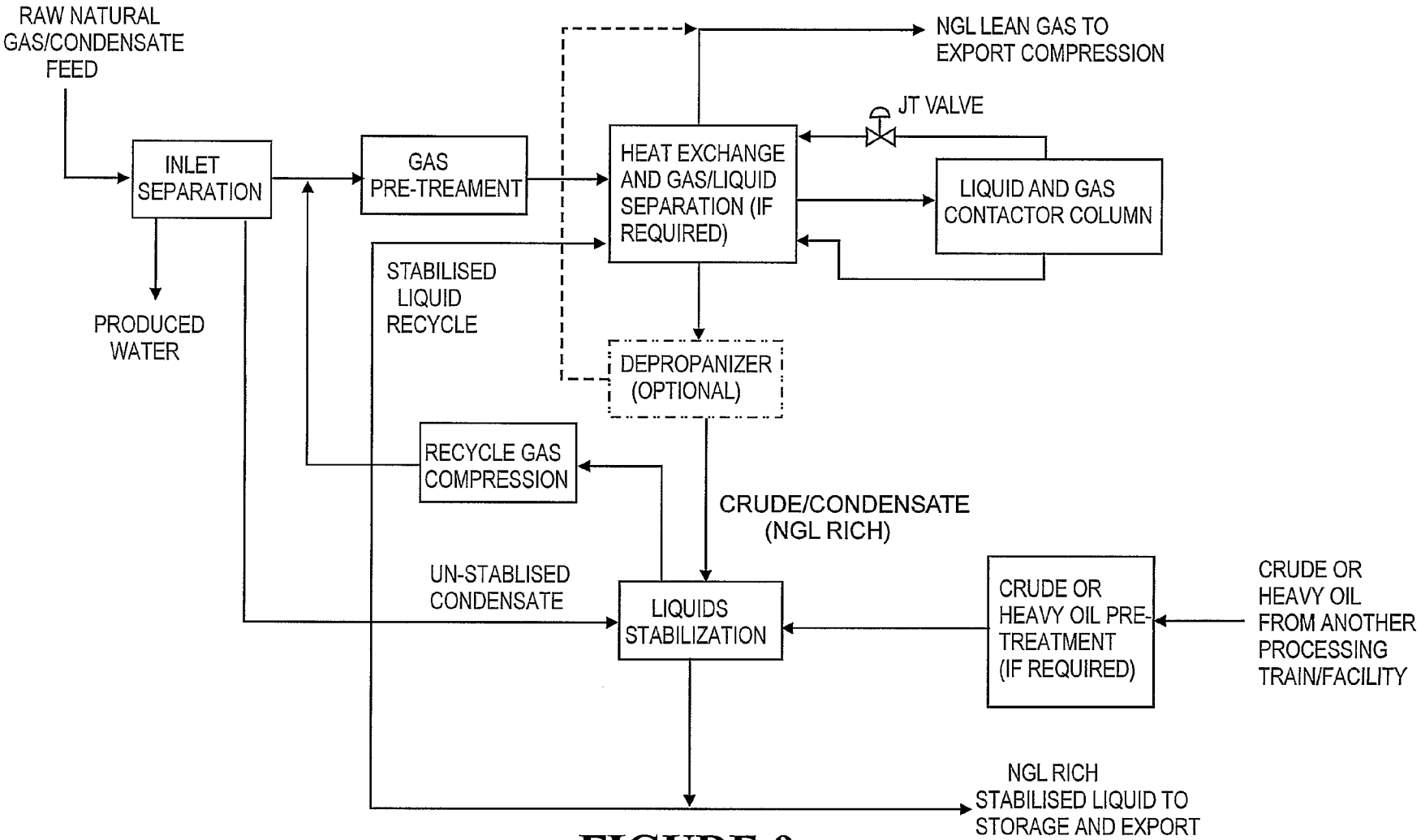
FIG. 9 illustrates schematically the process of the present invention according to a fifth preferred embodiment of the present invention.

The present invention, according to a fifth preferred embodiment, is illustrated schematically in FIG. 9. In this process scheme, crude or heavy oil either from an adjacent processing train or a remote train is routed to the top tray of the stabiliser column for contact with the un-stabilised liquids. The crude or heavy oil in this case functions as a column reflux and absorbs the NGLs whilst the lighter components and part of the propane are displaced from the crude and condensate and end up in the vapour stream in the column as column overheads. The stabiliser column bottoms will thus be a mix of crude and condensate which will be rich in NGLs that would otherwise have ended up in the overhead vapour recycle stream. Part of the bottoms from the stabiliser column, which includes a proportion of crude or heavy oil that is diluted with condensate extracted from the natural gas stream, is routed to a liquid and natural gas contactor column (after heat exchange). This is done in a similar manner as done in the first embodiment illustrated in FIG. 5. Single or multiple absorption columns are used to contact the liquid stream with the natural gas stream to absorb valuable NGLs from the natural gas stream. This configuration is advantageous if direct contact of crude or heavy oil on its own is not desirable due to pre-treatment requirements, high liquid viscosities at low temperatures, etc. The mix of crude or heavy oil and condensate from the bottom of the stabiliser column will be adequately dehydrated with low viscosity for direct contact with the natural gas.

Either crude oil or heavy oils may be used as the absorbent fluid in the OLHOA processes detailed in the inventive process schemes shown in FIGS. 5 to 9. For facilities that simultaneously produce and/or process crude oil and natural gas/condensate in parallel trains, using crude oil as the absorbent is economically beneficial. The crude from the crude processing train is routed to the gas processing train for use as an absorbent as depicted in the above typical process schemes. The crude may be stabilised or un-stabilised. The column operating pressure and temperatures are set such that NGLs will be preferentially absorbed into the crude with the lighter hydrocarbon components in the crude being displaced into the natural gas stream. The operating parameters of the contactor column and/or stabiliser will depend on the fluid composition of the natural gas and crude oil streams. Depending on the impurity content of the crude, crude pre-treatment facilities may also be required.

If crude oil is not produced in parallel with natural gas production, heavy oil may be used as the absorbent medium in the OLHOA processes of the present invention. The heavy oil may be one of the heavier products of a refinery atmospheric distillation column like heavy gas oil (HGO). This will provide superior performance as an absorbent over crude oil resulting in lower volumetric flow-rates, small column diameters and lower heating duties. It, however, entails higher operating costs associated with transportation of the heavy oil from, for example, a refinery to the gas processing plant. The Liquid Petroleum Gas (LPG) and heavier component rich heavy oil product from the gas processing train may then be re-exported to the refinery for processing to recover the NGLs. Heavy oil could also refer to condensate from another processing train provided it is heavier that the condensate produced from the said natural gas processing train.

The new crude oil or heavy oil absorption technology described hereinbefore offers several advantages over existing processes of LPG and heavier hydrocarbons recovery, wherein the main features are listed below:

1. The OLHOA process is an open loop NGL extraction process from natural gases using either crude oil or heavy oils.

2. The OLHOA process produces a natural gas export stream that is leaner in hydrocarbons higher than propane when compared to conventional JT valve, turbo-expander or refrigeration type processes. The product gas being leaner in heavy hydrocarbons improves export gas quality with reduced Wobbe Index and heating value.
3. The OLHOA process as embodied in FIGS. 5 and 9, unlike conventional methods, does not require deep chilling of the natural gas to enhance NGL recovery and thus significantly reduces gas pre-treatment requirements like molecular sieve gas dehydration facilities conventionally required for TBX and refrigeration type plants.
4. The OLHOA process is also more selective (compared to JT Valve, TBX or refrigeration type systems) in the recovery of butanes and heavier hydrocarbons into the liquid stream, thus improving recoveries as stabilised liquids.
5. Being an open loop absorption process, the OLHOA process does not require regeneration facilities to re-circulate the absorbent fluid that is required for lean oil absorption processes. Instead, most of the absorbed NGLs extracted from the natural gas stream remain in the crude or heavy oil stream which is pipelined under pressure or stabilised for storage and export under atmospheric conditions.
6. NGLs are typically extracted in conventional methods by firstly removing from the natural gas stream the NGLs using a lean oil absorption process and/or by chilling the natural gas stream using JT valve, TBX or refrigeration. This NGL is then processed in a NGL fractionation plant to split the NGLs into their individual components which are then stored and transported as liquids under pressure. The OLHOA process, unlike the conventional process described hereinbefore, will enable most of the extracted NGLs to remain in the liquid phase even when the liquid is stabilised. This will enable the product liquid to be transported safely for processing at refineries where the NGLs are more economically extracted and distributed.
7. For facilities which simultaneously produce and process natural gas and crude oil, as adjacent trains for example, the OLHOA process maximises use of crude oil to absorb NGLs from the natural gas stream. If natural gas is processed on its own, significant quantities of NGL will remain in the gas stream unless expensive NGL extraction plants as mentioned in item 6 above are provided.
8. Apart from its function as an absorbent fluid, the crude oil or heavy oil of the OLHOA process also functions as a carrier fluid for the recovered NGLs which will otherwise conventionally require to be transported under pressure, which, apart from being expensive is also hazardous. The OLHOA process which uses crude or heavy oil as a the NGL carrier fluid allows the recovered NGLs from the natural gas stream to be stored in atmospheric tanks and transported in the conventional manner identical to the way stabilised crude is normally transported.
9. The OLHOA process, as per the preferred embodiments depicted in FIGS. 6, 7 and 8, which function in conjunction with a JT Valve, TBX or refrigeration type system, allows for contact of the crude or heavy oil stream with NGL concentrated stream to enable efficient mass transfer.
10. The OLHOA process can be implemented with minimal modifications to existing facilities, particularly those processing concurrently natural gas and crude production.
11. The OLHOA process can improve the recovery of stabilised liquids by up to 20% over a TBX system depending on the composition of the natural gas and crude and the crude flow-rate.
12. The OLHOA process reduces the stabiliser column overhead vapour load and thus reduces the recycle compression power.
13. Weathering losses in crude oil storage tanks are reduced as crude oil that is stabilised in a column via the OLHOA process will have almost no methane and ethane and lower propane components which would otherwise result in vaporization losses at the storage tanks.
14. The installed cost of the OLHOA process system is expected to be significantly less than that of a TBX or refrigeration process especially if crude processing is also performed in the vicinity.

A summary of the unique features of the OLHOA process are listed below:

1. It is an open loop absorption process unlike the conventional lean oil absorption process which requires regeneration facilities to re-circulate the lean oil.
2. The absorbent fluid (crude or heavy oil) used in the natural gas processing train is sourced from another processing train or imported to the facility. It does not re-contact the gas with the liquids that are generated totally from the same natural gas processing train.
3. The absorption fluid (crude or heavy oil), apart from functioning as an absorbent, also functions as a carrier medium for the extracted NGLs. If it is stabilised, it will enable the storage and transportation of the product including the NGLs under atmospheric conditions.
4. The absorption fluid (crude or heavy oil) used in the process which after contacting with the natural gas or un-stabilised condensate is produced as a stabilised liquid product saturated with NGLs.
5. The liquid product, which includes the extracted NGLs and the absorption fluid (crude or heavy oil), can be readily processed in a typical crude processing refinery either on its own or after it has been commingled with other crudes.
6. When natural gas and crude are produced and/or processed in the vicinity of each other, the crude from the crude processing train may be used as the absorption fluid of the natural gas processing train. Conventionally, un-stabilised condensate from the natural gas processing is spiked into the crude processing train in an attempt to improve liquid yields. This, however, has generally proven not effective as the crude is already high in True Vapour Pressure (TVP) and the un-stabilised condensate immediately vaporises and does not achieve equilibrium with the crude to improve liquid yields.
7. In the OLHOA process the crude from the adjacent or nearby crude processing train (either stabilised or un-stabilised) is routed to either the absorber or stabiliser (depending on the process configuration used as detailed in FIGS. 5 to 9) for contact with fluid in the gas processing train. The contact process re-distributes the light hydrocarbon components to preferentially load the crude with NGLs and displace the lighter components in the crude into the gas stream. In this manner, the resulting product liquid will be laden with NGLs with minimal lighter hydrocarbon components. This will reduce weathering losses and shrinkage of the liquid product during storage and transportation.
8. The OLHOA process, as configured according to the process shown in FIG. 6 for example, contacts the crude or heavy oil with un-stabilised condensate (that is concentrated with NGLs) in the contactor and/or stabiliser instead of with process gas as is conventionally done in a conventional natural gas absorption process. This is beneficial for cases where contact with the main process gas stream with crude or heavy oil may not be desirable due to concerns with contamination of export gas with contaminants that may be present in the absorbent stream and to reduce crude or heavy oil pre-treatment requirement.

9. The OLHOA process, as configured according to the process shown in FIG. 9 for example, contacts a mix of absorbent fluid and condensate generated from the natural gas train to pre-condition the absorbent fluid to ensure its suitability for direct contact with the natural gas stream at predetermined conditions.

10. Other processes are available where condensate or crude are re-contacted with the gas from the same process train in an absorber column to achieve higher liquid yields. However, these processes only achieve incremental liquid yield of up to 5% against incremental yields expected to be up to 25% with the OLHOA process. These incremental yields are over that expected with conventional JT Valve, TBX or refrigeration processes.

Those skilled in the art will appreciate that various modifications may be made to the present invention without departing from the inventive concept thereof. The embodiments of the invention described herein are only meant to facilitate understanding of the invention and should not be construed as limiting the invention to those embodiments only. Those skilled in the art will appreciate that the embodiments of the invention described herein are susceptible to variations and modifications other than those specifically described. It is to be understood that the invention includes all such variations and modifications that fall within the scope of the inventive concept thereof.

The invention claimed is:

1. A process for extracting NGLs from natural gas into an absorbent fluid, comprising the steps of:

contacting a predominantly non-associated natural gas from a first processing train, from which said NGLs are to be extracted, with an absorbent fluid, that is a crude or heavy oil, from a second processing train in at least one contactor column for promoting absorption of said NGLs from said natural gas into said absorbent fluid for generating a NGL-rich fluid; and, displacing light hydrocarbons from said absorbent fluid into said natural gas for generating NGL-lean gas.

2. The process for extracting NGLs from natural gas according to claim 1, wherein said NGL-rich fluid is an NGL-rich, unstabilized fluid that is routed to a stabilizer column for stabilizing said NGL-rich fluid to atmospheric pressure.

3. The process for extracting NGLs from natural gas according to claim 2, wherein said NGL-rich, unstabilized fluid is routed to a de-propanizer prior to delivery to said stabilizer column.

4. The process for extracting NGLs from natural gas according to claim 1, wherein said NGLs include LPG.

5. The process for extracting NGLs from natural gas according to claim 4, wherein said LPG is comprises butane.

6. A process for extracting NGLs from natural gas into an absorbent fluid, comprising the steps of:

condensing in a dewpoint control system a predominately non-associated natural gas from a first processing train, from which NGLs are to be extracted, for forming a NGL-rich, unstablized condensate;

contacting said NGL-rich unstablized condensate with an absorbent fluid from a second processing train, said absorbent fluid being a crude or heavy oil, in a column for promoting absorption of said NGLs from said NGL-rich, unstablized condensate into said absorbent fluid for generating a NGL-rich fluid and condensate; and, displacing light hydrocarbons from said absorbent fluid and said NGL-rich unstablized condensate into a generated vapor stream of said column.

7. The process for extracting NGLs from natural gas according to claim 6, wherein said a column includes is a stabilizer column for stabilizing the generated NGLs-rich fluid and condensate to atmospheric pressure.

8. The process for extracting NGLs from natural gas according to claim 7, wherein said NGLs-rich unstabilized condensate is routed to a de-propanizer prior to delivery to said stabilizer column.

9. The process for extracting NGLs from natural gas according to claim 6, wherein said NGLs include LPG.

10. The process for extracting NGLs from natural gas according to claim 9, wherein said LPG comprises butane.

11. A process for extracting NGLs from natural gas into an absorbent fluid, comprising the steps of:

condensing in a dewpoint control system a predominantly non-associated natural gas from a first processing train, from which said NGLs are to be extracted, for forming a NGL-rich, unstablized condensate;

routing said NGL-rich, unstablized condensate to a stabilizer column;

contacting NGL-rich overhead vapor from said stabilizer column with an absorbent fluid from a second processing train, said absorbent fluid being crude or heavy oil, in a contractor column for promoting absorption of said NGL from said NGL-rich overhead vapor into said absorbent fluid for generating a NGL-rich fluid; and, displacing light hydrocarbons from said absorbent fluid into said NGL-rich overhead vapor for generating NGL-lean overhead vapor.

12. The process for extracting NGLs from natural gas according to claim 11, wherein said NGLs-rich un-stabilised condensate is routed to a de-propanizer prior to delivery to said stabilizer column.

13. The process for extracting NGLs from natural gas according to claim 11, wherein said NGLs include LPG.

14. The process for extracting NGLs from natural gas according to claim 13, wherein said LPG comprises butane.

15. A process for extracting NGLs from natural gas into an absorbent fluid, further comprising the steps of:

condensing in a dewpoint control system a predominantly non-associated natural gas from a first processing train, from which NGLs are to be extracted, for forming a NGL-rich, unstablized condensate;

routing said NGL-rich, unstablized condensate to a de-propanizer column, said NGL-rich, unstabilized condensate from a bottom portion of said de-propanizer column is routed to a pressure letdown valve followed by a flash vessel;

contacting NGLs-rich flash gas from said flash vessel with an absorbent fluid from a second processing train, said absorbent fluid being crude or heavy oil, in a contactor column for promoting absorption of said NGLs from said NGL-rich flash gas into said absorbent fluid for generating a NGLs-rich fluid; and, displacing light hydrocarbons from said absorbent fluid into said flash gas for generating NGL-lean overhead vapor.

16. The process for extracting NGLs from natural gas according to claim 15, wherein said de-propanizer column is a stabilizer column that is re-configured as a de-propanizer.

17. The process for extracting NGLs from natural gas according to claim 15, further comprising the step of having said NGL-rich unstabilized condensate from said bottom portion of said de-propanizer column routed to a pressure let-down valve and a heater prior to delivery to said flash vessel.

18. A process for extracting NGLs from natural gas into an absorbent fluid, comprising the steps of contacting a predominately non-associated natural gas from a first processing train, from which NGLs are to be extracted, with a portion of a NGL-rich mixture liquid in at least one contactor column for promoting absorpotion of NGLs from said natural gas into said portion of NGL-rich mixture liquid for generating NGL-rich, unstablized liquid;

displacing light hydrocarbons from said portion of NGL-rich mixture liquid into said natural gas for generating NGL-lean gas;

contacting said NGL-rich, unstablized liquid with an absorbent fluid from a second processing train, said absorbent fluid being a crude or heavy oil, in at least one stabilizer column for promoting absorption of NGLs from said NGL-rich, unstablized liquid in said absorbent fluid for generating said NGL-rich mixture liquid; and, displacing light hydrocarbons from said absorbent fluid and said NGL-rich, unstablized liquid into a generated vapor stream of said stabilizer column, a portion of said NGL-rich mixture liquid is said portion of NGL-rich mixture liquid that is recycled to said at least one contactor column for contacting said predominately non-associated natural gas.

19. The process for extracting NGLs from natural gas according to claim 18, further comprising the step of having said NGL-rich, un-stabilized liquid routed to a de-propanizer prior to delivery to said at least one stabilizer column.

20. The process for extracting NGLs from natural gas according to claim 18, wherein said NGLs include LPG.

* * * * *